US010307653B2

(12) United States Patent
Ebsen

(10) Patent No.: US 10,307,653 B2
(45) Date of Patent: Jun. 4, 2019

(54) GYMNASTICS GEAR

(71) Applicant: PE Redskaber A/S, Gram (DK)

(72) Inventor: Preben Ebsen, Rødding (DK)

(73) Assignee: PE Redskaber A/S, Gram (DK)

( * ) Notice: Subject to any disclaimer, the term of this patent is extended or adjusted under 35 U.S.C. 154(b) by 135 days.

(21) Appl. No.: 15/451,461

(22) Filed: Mar. 7, 2017

(65) Prior Publication Data

US 2017/0252624 A1 Sep. 7, 2017

(30) Foreign Application Priority Data

Mar. 7, 2016 (DK) ..... 2016 70133

(51) Int. Cl.
*A63B 5/16* (2006.01)
*A63B 69/00* (2006.01)

(52) U.S. Cl.
CPC ..... *A63B 69/0064* (2013.01); *A63B 5/16* (2013.01)

(58) Field of Classification Search
None
See application file for complete search history.

(56) References Cited

U.S. PATENT DOCUMENTS 2,496,748 A * 2/1950 Pond ..... A63B 7/00 434/247
3,006,645 A * 10/1961 Frazier ..... A63B 69/0064 182/3
3,085,357 A * 4/1963 Nissen ..... A63B 5/16 128/DIG. 15
3,721,216 A * 3/1973 Lippe ..... A01K 27/00 482/81
3,868,786 A * 3/1975 Lippe ..... A01K 27/001 446/28
4,275,880 A * 6/1981 Murphy ..... A61H 3/008 482/43

(Continued)

FOREIGN PATENT DOCUMENTS

DK 177862 B1 10/2014
EP 2803391 A1 11/2014

*Primary Examiner* — Stephen R Crow
(74) *Attorney, Agent, or Firm* — James Creighton Wray; Meera P. Narasimhan

(57) ABSTRACT

Gymnastics gear for performance of gymnastic exercises, where the gymnastics gear comprises at least a twisting belt, where the twisting belt comprises a first ring, typically an outer ring, and a second ring, typically an inner ring, where the two said rings are concentrically joined and can rotate in regard to each other about a common axis, where the first ring furthermore comprises at least two connection devices, where said connection devices are preferably arranged symmetrically at the outer periphery of the first ring and adapted for joining to a high-tensile or elastic rope, where the second ring also comprises connection devices at the periphery, where these connection devices are adapted for direct or indirect mounting of connection elements to a somersault belt, where the somersault belt is an inflatable somersault belt comprising at least one chamber and at least one valve, which achieves both a good centering of the somersault belt and a good tightening to the body of the gymnast, and where one and the same somersault belt can be adapted to gymnasts of different size as optimally as possible.

16 Claims, 6 Drawing Sheets

(56) References Cited

U.S. PATENT DOCUMENTS

| | | | | | |
|---|---|---|---|---|---|
| 4,961,574 | A * | 10/1990 | Lew | A63B 69/0064 | 280/206 |
| 5,221,241 | A * | 6/1993 | Bare, II | A63B 69/0064 | 482/124 |
| 5,360,384 | A | 11/1994 | Toensing | | |
| 5,372,565 | A * | 12/1994 | Burdenko | A63B 21/0552 | 482/124 |
| 6,368,296 | B1 * | 4/2002 | Eiter | A63B 21/4009 | 482/146 |
| 6,520,290 | B1 * | 2/2003 | Carter | A62B 35/0037 | 182/3 |
| 6,520,893 | B2 * | 2/2003 | Bray | A63B 23/0211 | 482/111 |
| 7,077,794 | B1 * | 7/2006 | Bray | A41D 13/0525 | 482/111 |
| 7,753,829 | B1 * | 7/2010 | Schaller | A63B 21/0004 | 482/132 |
| 9,463,369 | B2 * | 10/2016 | Ebsen | A63B 69/0064 | |
| 9,873,015 | B2 * | 1/2018 | Jolly | A63B 23/025 | |
| 2002/0010060 | A1 * | 1/2002 | Bray | A63B 23/0211 | 482/140 |
| 2011/0160022 | A1 * | 6/2011 | Sato | A61H 9/0078 | 482/113 |
| 2013/0085046 | A1 * | 4/2013 | Jolly | A63B 23/025 | 482/129 |
| 2014/0342879 | A1 | 11/2014 | Ebsen | | |
| 2018/0140892 | A1 * | 5/2018 | Thomas | A63B 21/4009 | |

* cited by examiner

GYMNASTICS GEAR

This application claims the benefit of Danish Application No. PA 2016 70133 filed Mar. 7, 2016, which is hereby incorporated by reference in their entirety as if fully set forth herein.

FIELD OF THE INVENTION

The present invention concerns a gymnastics gear for performance of gymnastic exercises, where the gymnastics gear comprises at least a twisting belt, where the twisting belt comprises a first ring, typically an outer ring, and a second ring, typically an inner ring, where the two said rings are concentrically joined and can rotate in regard to each other about a common axis, where the first ring furthermore comprises at least two connection devices, where said connection devices are preferably arranged symmetrically to the outer periphery of the first ring and adapted for joining to a high-tensile or elastic rope, where the second ring also comprises connection devices at the periphery, where these connection devices are adapted for direct or indirect mounting of connection elements for a somersault belt.

The present invention likewise concerns an inflatable somersault belt for use in a gymnastics gear and a method for use of such a gymnastics gear.

PRIOR ART

In connection with the performance of jumping gymnastics from the floor, from a mat or on a trampoline or similar elastic gymnastics gear, the gymnast may be strapped up in two or more straps—typically in elastic ropes when using a trampoline or otherwise in high-tensile ropes—which are secured either a good distance above the gymnast or at least above their center of gravity. For certain of these specific gymnastic exercises, so-called twisting belts are used, where the gymnast is secured in the twisting belt via a somersault belt or the like. Wearing this gear, the gymnast can undertake jumps, and while the gymnast is in the air they can perform a lot of different exercises, including flips and twisting exercises, where the gymnast turns about both his own transverse axis and his longitudinal axis.

A twisting belt is typically made of metal, such as aluminum, and it comprises an outer ring and an inner ring and between these rings there are arranged bearing balls or rollers. The innermost of the two rings can thus rotate in relation to the outermost ring about a common central axis—as is known in principle from traditional ball bearings from countless applications, such as the machine industry. The common central axis in the twisting belt corresponds in principle to a gymnast's longitudinal axis when he or she is placed in the twisting belt.

The outer ring typically comprises fixation means in the form of eyes or the like, which are placed at around 180 degree offset on the external periphery of the outer ring. These eyes are used to secure the mentioned elastic ropes—typically one or more on each side.

At the periphery of the internal ring there is likewise arranged a number of fixation means or eyes, through which there is drawn either a wire, a rope, or an elastic rope. To this rope are then secured straps, which are arranged on an external side of the mentioned somersault belt.

The somersault belt has the effect that the gymnast is supported at least by a belt around their waist, but often also with belts or straps around each of their legs or thighs, which is also known from climbing gear and other types of safety belts. The somersault belts however typically have four straps along the external periphery, through which the mentioned rope or wire is drawn. It is thus the length of the straps and the rigidity of the rope which determine the mutual adjustment possibilities between the twisting belt and the somersault belt.

The number of these eyes varies from one twisting belt to another and there are typically between 4 and 10 such eyes, more or less evenly distributed along the periphery at the internal ring of the twisting belt.

Many eyes on the internal ring means that the somersault belt itself and thus the gymnast can be better centered in the twisting belt, which is very important to performing the exercises optimally. At the same time, however, this means less possibility of a good and optimal tightening of the somersault belt itself to the body of the gymnast, since the somersault belt is fixed relatively firmly and centrally in the twisting belt.

Few eyes on the internal ring means that the somersault belt itself and thus the gymnast cannot be so easily centered in the twisting belt, which as already mentioned is very important to performing the exercises optimally. But fewer eyes means a better possibility of a good and optimal tightening of the somersault belt itself to the body of the gymnast, since because of the few eyes the somersault belt is more flexibly fixed in the twisting belt.

Thus, regardless of whether there are many or few eyes, there are some inconveniences with these solutions, since there is either a good centering of the somersault belt or a good tightening to the body of the gymnast—both conditions are important, but only one of the conditions can be optimally achieved. There is an attempt to solve this problem with certain twisting belts either by mounting steel wires or elastic ropes in the mentioned eyes in order to thereby optimize the possibility for a simultaneous good centering of the gymnast and for a perfect tightening of the somersault belt itself to the body of the gymnast.

Even so, none of these solutions is optimal or allows the gymnast to be centered enough to have an optimal and individual tightening of the somersault belt to the body. Therefore, one must typically purchase both twisting belts and internally mounted somersault belts in different sizes, and then one of the available sizes will fit best—or at least well enough in the best of cases—but most of the time these twisting belts with firmly mounted somersault belts only fit somewhat.

Furthermore, it is customary with these solutions for one to have two, three or more twisting belts with somersault belts in each size—typically three different sizes—so that one gymnast can wear the gear and stand ready to perform the exercise while another gymnast is already doing so.

Such twisting belts with mounted somersault belts are relatively costly and it is therefore highly attractive to be able to purchase as few of them as possible and at the same time achieve a good flexibility during use, so that for example a trampoline and the elastic ropes can be utilized optimally.

One example of gymnastics gear for performance of gymnastic exercises involving a twisting belt with an outer and an inner ring which are concentrically joined is known from U.S. Pat. No. 2,496,748.

From DK 177862 B1 there is known how to mount a somersault belt easily and without problem on and off a twisting belt. This means that one does not need to have a plurality of twisting belts, but only a plurality of somersault belts. This naturally has a significant influence on the economics, since it is certainly the twisting belts which are the most costly.

PURPOSE OF THE INVENTION

One purpose of the invention is to provide a twisting belt which achieves both a good centering of the somersault belt and thus also of the gymnast, and a good tightening to the body of the gymnast, and where one and the same somersault belt can be adapted to gymnasts of different size as optimally as possible.

A further purpose of the invention is that the adjustment of the somersault belt can be done after the gymnast has put on the twisting belt, so that the adjustment can be done quickly and easily.

Likewise, one purpose of the invention is for the twisting belt to make it possible for the gymnast to adjust the belts or straps around the legs or thighs of the gymnast likewise in a quick and easy manner.

A further purpose of the invention is for the somersault belt to be as easy and comfortable as possible for the gymnast both to wear and to use and take off.

Furthermore, one purpose of the invention is to provide an inflatable somersault belt and to use such an inflatable somersault belt along or in combination with both new and existing twisting belts.

DESCRIPTION OF THE INVENTION

According to a first aspect of the invention, the aforementioned purpose is achieved with a gymnastics gear as described in the introduction for the performing of gymnastic exercises, where the gymnastics gear comprises at least a twisting belt, where the twisting belt comprises a first ring, typically an outer ring, and a second ring, typically an inner ring, where the two said rings are concentrically joined and rotatable in regard to each other about a common axis, where the first ring furthermore comprises at least two connection devices, where said connection devices are preferably arranged symmetrically at the outer periphery of the first ring and adapted for joining to a high-tensile or elastic rope, where the second ring also comprises connection devices at the periphery, where these connection devices are adapted for direct or indirect mounting of connection elements to a somersault belt, wherein the somersault belt is an inflatable somersault belt comprising at least one chamber and at least one valve.

Thus, it is possible to inflate the somersault belt with the aid of a compressor for example or a manual pump—such as a ball-type manual pump—which may be connected by a hose to the valve. The pump itself can be mounted on the belt. This achieves both a good centering of the somersault belt and a good tightening to the body of the gymnast, where one and the same somersault belt is able to be adapted to gymnasts of different size as optimally as possible. The valve can furthermore have an excess pressure device so that the pressure is regulated to make sure that the inflatable somersault belt cannot burst. An excess pressure device can thus be an excess pressure valve which regulates the pressure. The larger the valve, the more quickly can the air both be pumped into the belt and let out from the belt in connection with a switch in the gymnasts using the gymnastics gear.

By inflatable is meant here the possibility of using and pumping a desired type of gas or a mixture or gases such as preferably air into the inflatable somersault belt.

Alternatively, one may consider an inflatable somersault belt with a multichamber system, where the chambers are interconnected and where one valve is thus enough. In a further alternative embodiment, one may consider several separate chambers, one above another, alongside of each other, or on the outside of each other, where one or more chambers could be inflated for a start, while the other chambers could be inflated when the gymnast dons the somersault belt. Thus, one may consider a system with several valves.

The adjustment of the somersault belt may be done after the gymnast has donned the twisting belt, so that the adjustment can be done quickly and easily by simply pumping air via the valve into the somersault belt until the gymnast is tightened up. When the gymnast wants to remove the somersault belt once more, air is let out from the valve until the gymnast can take off the somersault belt, all of which is done in an easy and comfortable manner, which makes it easy, quick, and user-friendly for the gymnasts to put on the somersault belt, use it, and take it off.

This makes it possible to have a twisting belt and a somersault belt as an integrated unit, since there is no need for these belts to be separated from each other. Furthermore, this makes it possible to have the twisting belts in a slightly smaller external dimension as long as the inflatable somersault belt can be secured directly in the second ring, which is the internal ring.

The present invention in a second aspect also involves a gymnastics gear, where the twisting belt furthermore comprises a number of the mentioned connection elements in the form of straps, preferably four or more straps, where one or more and preferably all of the mentioned straps are designed with joining means for connecting to complementary joining means on either the strap itself, on the second ring, or on an inflatable somersault belt.

This makes it possible for an inflatable somersault belt to be mounted easily and without problem in a twisting belt or removed from it. This also means that one does not need to have several twisting belts on hand, or several inflatable somersault belts, which naturally has an important influence on economics. Furthermore, it is also possible to switch out the fixed somersault belts of existing twisting belts for inflatable somersault belts according to the invention.

In a preferred embodiment, either the mentioned straps and/or the mentioned joining means can furthermore comprise adjustment means for adjusting the length of the mentioned strap(s) and thus the distance between the inflatable somersault belt and the second ring in the twisting belt.

The connection elements or straps may at the same time be designed advantageously so that their length is adjustable, so that the inflatable somersault belt itself can be more easily adjusted in the twisting belt, while the inflatable somersault belt can then be optimally adapted to the individual gymnast. Thus, there is no compromise between an optimal tightening of the inflatable somersault belt and an optimal centering in the twisting belt.

The present invention also involves in a third aspect a gymnastics gear, where the second ring comprises a recess—a groove—along the periphery, where the recess comprises an opening, where the opening is adapted to receive one or more connection elements, where said opening has a size which is narrower than the recess itself.

This makes it possible to place for example the end of one strap on an inflatable somersault belt in the mentioned recess through the narrow opening and then lock the end of the strap so that it cannot be pulled out from the narrow opening. The major benefit of the recess is that the placements of the straps are arbitrarily chosen and thus they can be adapted by a simple displacement to one side or another. At the same time, there are no limitations on the placements of the straps, or the number of straps.

In one variant of a gymnastics gear according to the invention the mentioned connection elements can comprise joining means, where the joining means comprise Velcro fastenings. By making the connection elements/straps with an adjustable closing device having Velcro fasteners, they can be easily adjusted in length by loosening and lengthening or shortening the strap and locking it once more with the mentioned Velcro fastener. At the same time, it is easy to open and thus remove an inflatable somersault belt (and the gymnast) from the twisting belt.

The present invention also involves in a fourth aspect a gymnastics gear, where the mentioned connection elements comprise joining means, where the joining means comprise mechanical coupling elements.

This makes it possible to achieve a flexibility in the gymnastics gear, where known fixed somersault belts and new inflatable somersault belts can both be used with the same twisting belt.

Such mechanical coupling elements can be, for example, couplings or buckles between the twisting belt and the inflatable somersault belt. For example, one may use buckles such as are known from seat belts, backpacks, guitar straps and so forth. This type of coupling element can be called "click buckles", but other types of coupling elements could be used. By using couplings between a twisting belt and a somersault belt, one can connect gymnasts already wearing a usual somersault belt or an inflatable somersault belt to the twisting belt immediately before performing the gymnastic exercises.

When an inflatable somersault belt is used, a single twisting belt can be used for all sizes of gymnasts and the twisting belt and the inflatable somersault belt do not need to be removed from the high-tensile or elastic ropes when a new gymnast takes their place.

However, the mechanical coupling means can be retrofitted on existing twisting belts and one can therefore simply switch out the old somersault belts for new inflatable somersault belts and therefore keep the somewhat more expensive twisting belts.

The adjustable joining means, which can thus be designed with buckles of suitable type, can be mounted on both the twisting belt and on the inflatable somersault belt or on both items. By employing a compact buckle such as is known from the shoulder straps on parachutes, where it is possible to adjust the length on the strap in at least one part, an extremely robust, secure and compact solution is achieved.

For example, a number of couplings—typically four—can be arranged between the twisting belt and the inflatable somersault belt, having the effect in an easy and problem-free manner that the two parts can be coupled together and not least of all be adjusted in relation to each other.

Thanks to adjusting the fixation straps between the two belts, a further possibility is achieved of centering the gymnast, while at the same time a more secure/firm tightening during use of the inflatable somersault belt increases the comfort of the user, since a much better control is achieved while performing the gymnastic exercises.

A gymnastics gear according to the invention can advantageously comprise one or more locking devices, which are adapted for mounting in the mentioned recess/groove in the second ring, where the mentioned locking device(s) are adapted for a connection to one or more of the mentioned connection elements. In the most simple form, one may consider that one strap end, where the end consists of a folded strap—that is, two layers—is placed in the recess, and then a dowel, a rod, a rope or the like is placed between these two layers at the end of the strap. In this way, the strap is blocked in the recess in a secure and effective manner.

The gymnastics gear according to the invention can have the mentioned locking devices consist of a rod-shaped or ring-shaped material, with a cross sectional geometry which is smaller than the cross sectional geometry at the mentioned recess. The locking thus occurs in that the rod or ring is shoved into the recess through an appropriately designed opening in the second/inner ring in the twisting belt. The necessary straps can be mounted on this ring and then be moved freely and precisely to the desired individual position on the internal periphery of the twisting belt.

The locking device can be led through one or more eyes on the connection elements/straps between the twisting belt and the inflatable somersault belt. At the same time, all straps can be fully adjustable.

The inflatable somersault belt in its most simple form can be a hose, a cylinder or a sausage.

The present invention also involves in a fifth aspect a gymnastics gear, where the at least one chamber comprises at least a number of wires placed between the outer side and the inner side of the inflatable somersault belt.

This makes it possible to secure the inflatable somersault belt in a given shape and with a given distance between the outer side of the inflatable somersault belt and the inner side of the inflatable somersault belt, where the wires ensure that the outer side of the inflatable somersault belt and the inner side of the inflatable somersault belt can only move for a distance from each other as defined by the lengths of the wires. Accordingly, there is a maximum spacing arrangement between the outer side of the inflatable somersault belt and the inner side of the inflatable somersault belt.

Alternatively, the wires could be replaced by bands, ribs, walls or the like, which for example in points or lines are able to secure the outer side and the inner side of the inflatable somersault belt at a maximum distance from each other.

The present invention also involves in a sixth aspect a gymnastics gear, where the gymnastics gear furthermore comprises inflatable leg belts/straps each comprising at least one chamber and at least one valve, where the inflatable leg belts/straps are connected to the twisting belt.

This makes it possible to have a connection between the inflatable somersault belt and the inflatable leg belts/straps, by which air can be pumped further over into the leg belts. With this solution, leg belts/straps can be "loose" in relation to the actual part of the inflatable somersault belt which is tightened about the body of the gymnast, which means an increased flexibility and adjustment possibility. At the same time, all straps can be fully adjustable. Leg belts/straps can be secured movably in the inner ring as well as the inflatable somersault belt itself. The whole can be shoved and moved in relation to each other for optimal centering of the gymnast and at the same time for optimal tightening of an inflatable somersault belt on the gymnast.

Furthermore, the gymnastics gear can also comprise shoulder belts, H-braces, or the like, which can likewise be inflatable in corresponding manner to the leg belts.

The present invention also involves in a seventh aspect a gymnastics gear, where the inflatable leg belts are connected to a manual pump.

This makes it possible to have a separate manual pump for leg belts, insofar as no connection is present between the inflatable somersault belt and the inflatable leg belts/straps.

The manual pump for example can be placed and fastened to the outer side of the somersault belt, where the pump will not be in the way of the movements of the gymnast. The pump can thus be fastened via a hose to the valves of the leg belts.

The present invention also involves in an eighth aspect a gymnastics gear, wherein either the first or the second ring at least is designed wholly or partly of fiber composite, where the fibers for example are glass fibers, carbon fibers, vegetable fibers or combinations of these.

This makes it possible to design the gymnastics gear so that either the first or the second ring at least is designed wholly or partly of fiber composite, where the fibers for example are glass fibers, carbon fibers, vegetable fibers or combinations of these. In this way, one can achieve a strong and extremely robust product. However, it is clear that all or some of the two rings in the twisting belt can also be made of other suitable materials, including aluminum, which can advantageously be rolled extruded profiles and/or bodies that are machined by chip-removing processes.

The present invention also involves in a ninth aspect a gymnastics gear, wherein there is arranged between the first and the second ring a number of bearing balls and/or bearing rollers, where said bearing balls and bearing rollers are made of steel, ceramics, or some other shape-stable and friction-resistant material.

This makes it possible to design the gymnastics gear so that there is arranged between the first and the second ring a number of bearing balls and/or bearing rollers, where said bearing balls and bearing rollers are made of steel, ceramics, or some other shape-stable and friction-resistant material, in order to achieve in this way a sufficiently low rolling resistance between the two rings in the twisting belt.

The present invention also involves in a tenth aspect an inflatable somersault belt for use in a gymnastics gear according to the invention, where the inflatable somersault belt comprises at least one chamber and at least one valve, as well as a number of connection elements.

This makes it possible to switch out existing somersault belts for a new and inflatable somersault belt. The valve can furthermore have an excess pressure device so that the pressure is regulated to make sure that the inflatable somersault belt cannot burst. An excess pressure device can thus be an excess pressure valve which regulates the pressure. The larger the valve, the more quickly can the air both be pumped into the belt and let out from the belt in connection with a switch in the gymnasts using the gymnastics gear.

The present invention also involves in an eleventh aspect a method for use of a gymnastics gear, where the method involves at least the following steps:

- at least the inflatable somersault belt is placed around the body of a gymnast,
- a gas species, such as air, is pumped via a valve into the at least one chamber of the inflatable somersault belt.

This makes it possible in very few steps to fasten and secure the gymnastics gear on a gymnast, where the inflatable somersault belt comprises a number of connection elements/straps at its periphery, and where the mentioned connection elements are already secured to the second inner ring, for example by a high-tensile or elastic rope.

Preferably the at least one chamber of the inflatable somersault belt is pumped up until a predefined pressure is reached.

In the event that the inflatable somersault belt is not an integrated part of the twisting belt, but instead a separate part of the gymnastics gear, the inflatable somersault belt can be mounted directly or indirectly on the second ring in the twisting belt by direct or indirect mounting of length-adjustable joining means on the periphery of the inflatable somersault belt, for example via a high-tensile or elastic rope on the periphery of the second ring of the twisting belt.

DESCRIPTION OF DRAWINGS

In the description of the figures, identical or corresponding elements will be designated with the same reference symbol in the various figures. Thus, an explanation will not be given for all details in connection with each individual figure or embodiment.

LIST OF REFERENCE SYMBOLS

Figure 1:
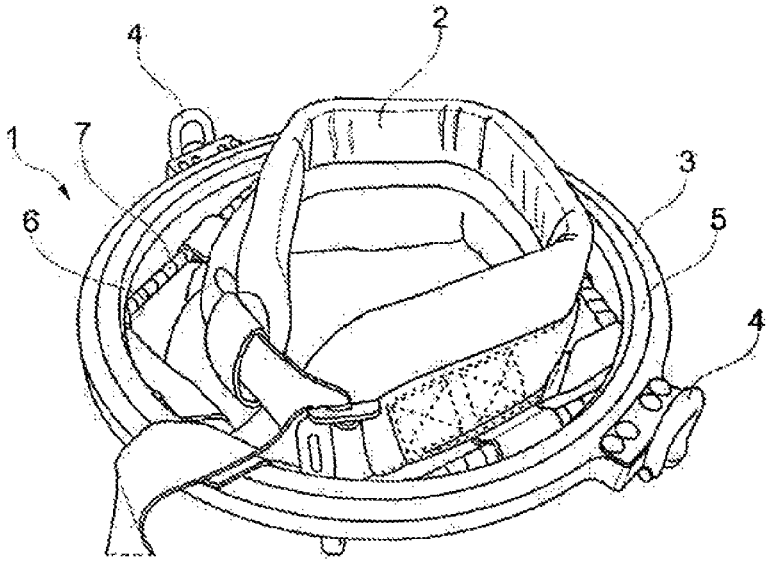
FIG. 1 shows a twisting belt with a somersault belt according to the prior art.

1 Twisting belt
2 Inflatable somersault belt
3 First/outer ring
4 Connection devices on the first/outer ring
5 Second/inner ring
6 Connection devices on the second/inner ring
7 High-tensile or elastic rope in the second/inner ring
8 Connection elements/straps
9 Joining means/coupling elements
10 Eyes in inner ring
11 Adjustment means
12 Locking means
13 Recess for bearing balls/rollers at outer periphery on the second/inner ring
14 Bearing balls/rollers
15 Recess in the internal periphery of the second/inner ring
16 Inner area in inner recess
17 Opening in the inner recess
18 Insert opening in the inner recess
19 Locking device in the inner recess
20 Valve
21 Wire
22 Outer side, inflatable somersault belt
23 Inner side, inflatable somersault belt
24 Chamber

DETAILED DESCRIPTION OF THE INVENTION

FIG. 1 shows a twisting belt 1 with somersault belt 2 according to the prior art. The outer ring 3, also called the first ring 3, is shown here with two connection devices 4, in which the twisting belt 1 can be suspended from ropes, not shown. The outer ring 3 is connected coaxially and rotatably to the inner ring 5, also called the second ring 5. On the second ring 5 there are arranged connection devices 6 for the somersault belt 2. In the variant shown, these connection devices 6 are comprised of a number of eyes, there being arranged in these eyes an elastic rope 7, to which the somersault belt 2 itself is secured. By using an elastic rope 7, the somersault belt 2 can be more easily pulled toward the body of the gymnast in order to achieve an optimal tightening. However, this results in a suboptimal centering of the gymnast in the twisting belt 1 itself.

Figure 2:
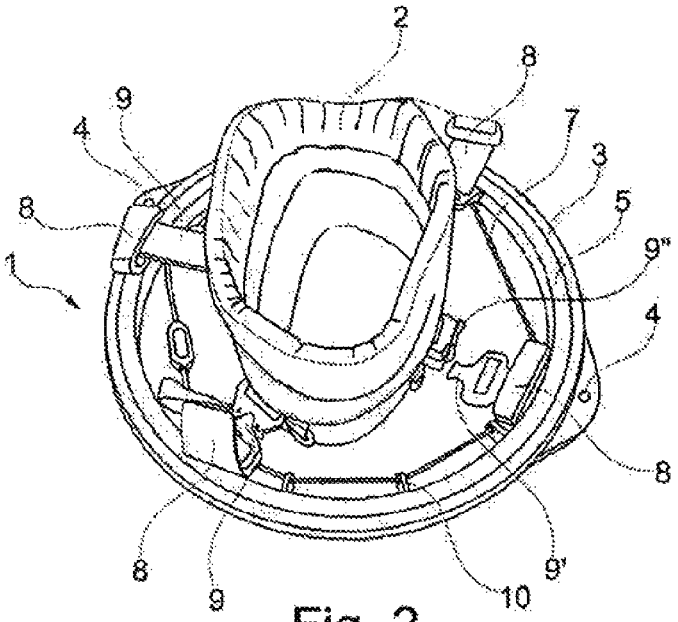
FIG. 2 shows a twisting belt with a somersault belt with adjustable straps.

FIG. 2 shows a twisting belt 1 with mounted inflatable somersault belt 2, where there are adjustable straps 8 between the inflatable somersault belt 2 and the inner ring 5 of the twisting belt. On the mentioned straps 8 there are arranged joining means/coupling elements 9, one of which is shown open, enabling a quick and easy joining between an inflatable somersault belt 2 and a twisting belt 1. The gymnast can thus be wearing an inflatable somersault belt 2 and when it comes time he can be easily connected firmly to the twisting belt 1. The mentioned joining means/coupling elements 9 have one part 9' secured to the aforementioned connection devices 6 in the inner ring 5, which consists here of a high-tensile rope 7, mounted in eyes 10. The other part 9" of the joining means/coupling elements 9 is secured to the inflatable somersault belt 2.

Figure 3:
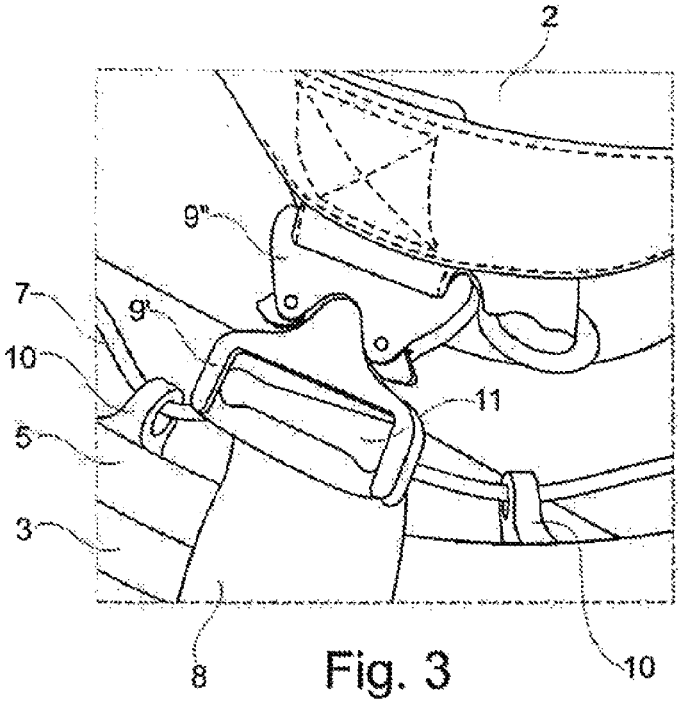
FIG. 3 shows an adjustable click buckle between an inflatable somersault belt and a twisting belt.

FIG. 3 shows joining means/coupling elements 9 in the form of an adjustable click buckle between an inflatable somersault belt 2 and a twisting belt 1. One part of the joining means/coupling element 9' is secured to the high-tensile rope 7, and the other part 9" is secured to an inflatable somersault belt 2. Between the high-tensile rope 7 and the one part 9' of the joining means/coupling element 9, the strap 8 itself is mounted in adjustment means 11 in relation to the one part 9' of the joining means/coupling element. This makes it possible to adjust the length of the strap and thus to center the inflatable somersault belt perfectly in relation to the twisting belt 1, while at the same time the inflatable somersault belt 2 is perfectly tightened against the body of the gymnast.

Figure 4:
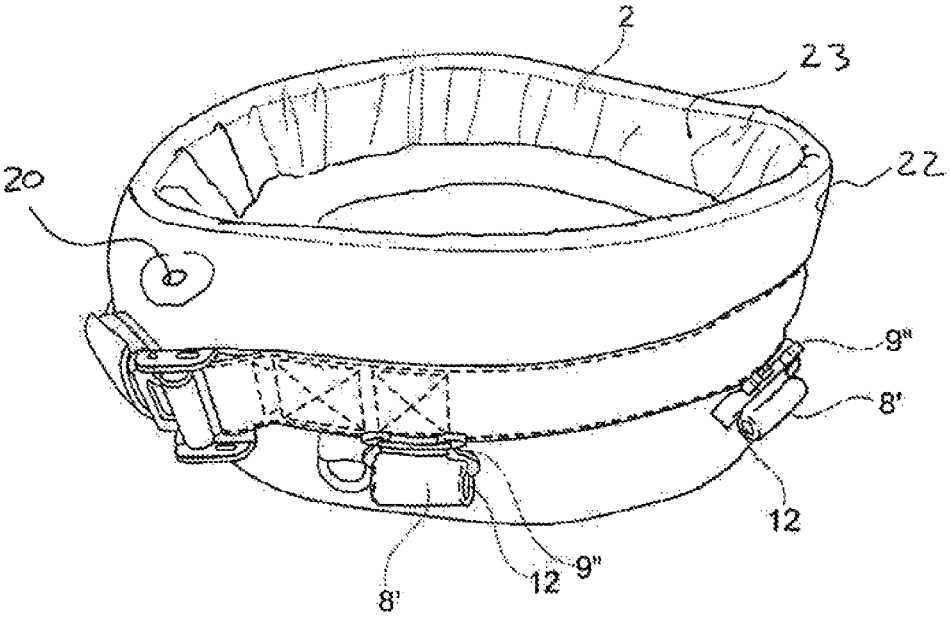
FIG. 4 shows an inflatable somersault belt with click buckle parts mounted on it.

FIG. 4 shows an inflatable somersault belt 2 with joining means/coupling elements 9" mounted on it. This is an inflatable somersault belt 2 which is outfitted with the advantageous joining means/coupling elements 9 and thus can be easily and quickly coupled to the inner ring 5 on also other twisting belts. The strap 8' on the inflatable somersault belt 2 is led here through a slot in the joining means/coupling element 9" and then blocked with a locking element 12. The figure furthermore shows a valve 20, which can be connected to a compressor or a manual pump, optionally via a hose.

Figure 5:
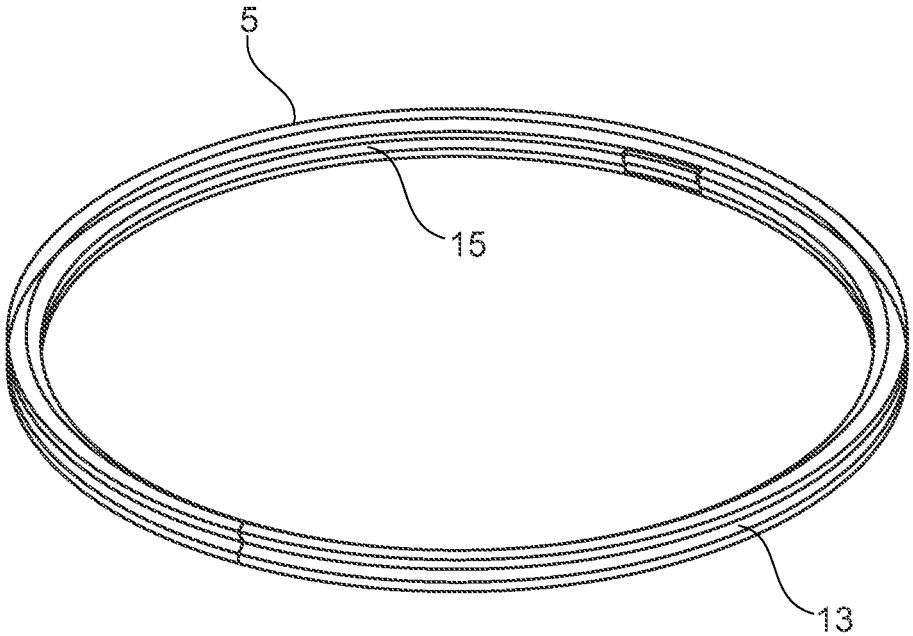
FIG. 5 shows the inner ring of a twisting belt.

FIG. 5 shows the inner ring 5 of a twisting belt 1, where there is arranged on the outer periphery a recess 13 for bearing balls/rollers 14, not shown. This is essentially a recess 13 which largely corresponds to the one present on common types of ball or roller bearings. On the internal periphery of the inner ring 5 there is seen a recess 15 for entirely arbitrary placement of the straps 8 connecting an inflatable somersault belt 2 to the twisting belt 1.

Figure 6:
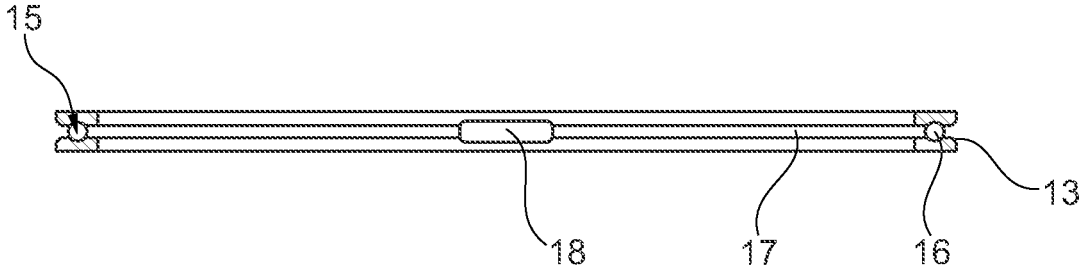
FIG. 6 shows a cross section of the inner ring.

FIG. 6 shows a cross section of the same inner ring 5 as seen in FIG. 5. The recess 15 is shown here with a greater internal height 16 than the height of the opening 17 itself. Furthermore, there is shown an insert opening 18, through which straps 8 or the like can be inserted into the recess 15. This will be shown and described in further detail in FIG. 7. FIG. 6 also shows the previously mentioned outer recess 13 for bearing balls/rollers 14, not shown.

Figure 7:
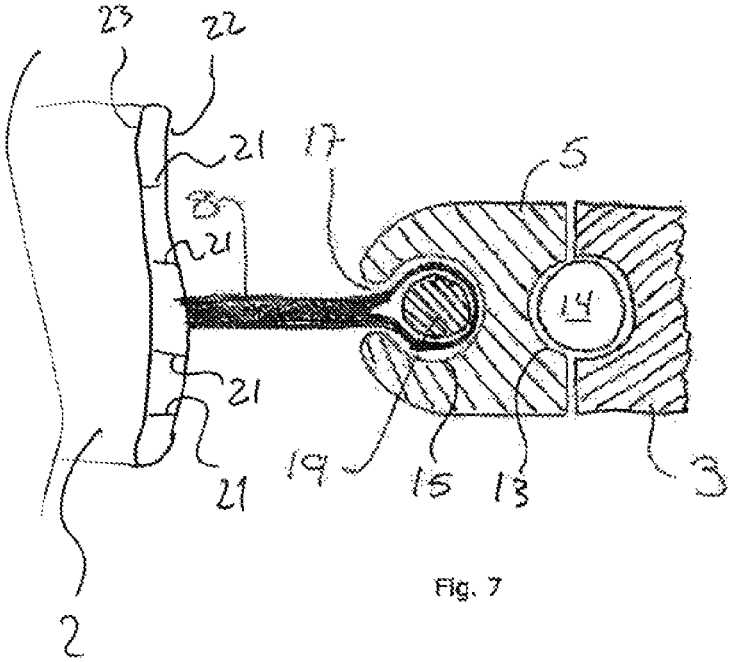
FIG. 7 shows yet another cross section of the inner ring with recesses, strap and lock element.

FIG. 7 shows a cross section of part of the outer ring 3 and the inner ring 5 with recesses 13 and with bearing balls/rollers 14. In the recess 15 in the inner ring 5 there is arranged a strap 8, where the strap 8 forms an eye, and where there is arranged in this eye a locking device 19. In this way, it becomes possible to shift the strap 8—there will usually be four straps 8 between the inner ring 5 and an inflatable somersault belt 2 and perhaps one or two straps 8 for each of two leg belts—along the periphery of the inner ring 5. In this way, the straps 8 can be placed entirely as the user desires, and it is thus possible to achieve an optimal and heretofore unprecedented perfect tightening of the inflatable somersault belt 2 against the gymnast, while at the same time achieving a perfect centering of the gymnast in the twisting belt 1.

FIG. 7 also shows a cross section of an inflatable somersault belt 2, where in a chamber 24 there are a number of wires 21 connecting the outer side 22 of an inflatable somersault belt 2 to the inner side 23 of an inflatable somersault belt 2, thereby ensuring that the outer side 22 of the inflatable somersault belt and the inner side 23 of the inflatable somersault belt can only move for a distance from each other that is defined by the lengths of the wires.

Figure 8:
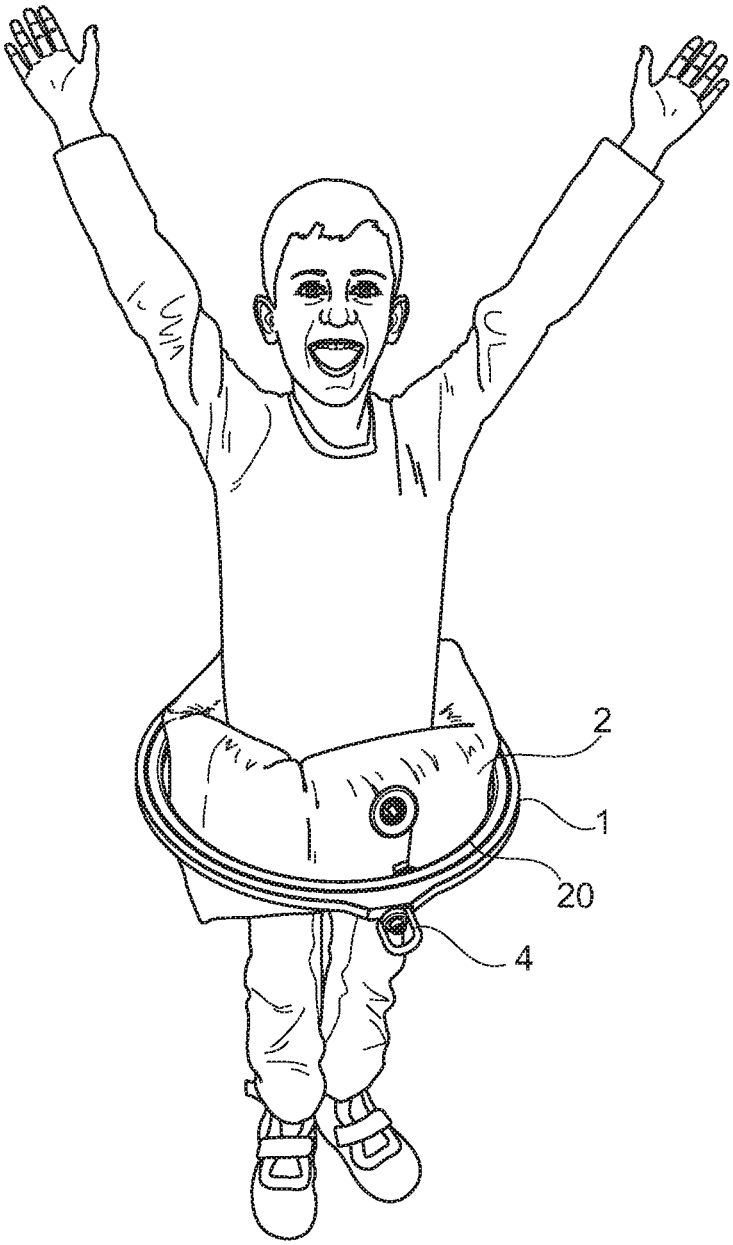
FIG. 8 shows a twisting belt with inflatable somersault belt with gymnast.

FIG. 8 shows a twisting belt 1 with inflatable somersault belt 2, in which a gymnast is tightened up, and where there is a visible connection device on the first/outer ring 4 and a valve 20 on the somersault belt 2.

Figure 9:
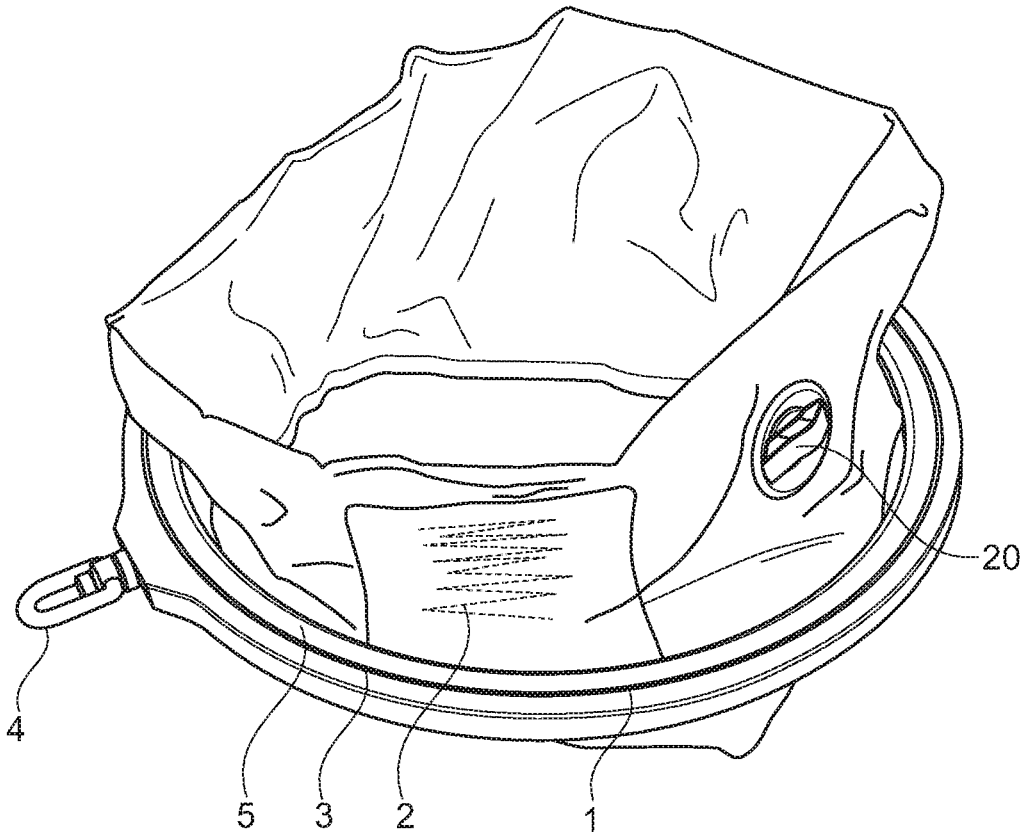
FIG. 9 shows a twisting belt with inflatable somersault belt in a preferred embodiment.

FIG. 9 shows a twisting belt 1 with inflatable somersault belt 2 in a preferred embodiment, where the inflatable somersault belt 2 is not pumped up, but where the valve 20 is visible on the inflatable somersault belt 2.

The invention claimed is:

1. Gymnastics gear for performance of gymnastic exercises, where the gymnastics gear comprises at least a twisting belt and a somersault belt, where the twisting belt comprises a first ring as an outer ring, and a second ring as an inner ring, where the two said rings are concentrically joined and rotatable in regard to each other about a common axis, where the first ring furthermore comprises at least two connection devices, where said connection devices are arranged on the outer periphery of the first ring (3) and adapted for joining to a high-tensile or elastic rope, where the second ring also comprises connection devices at the periphery for connecting to complementary connection elements of the somersault belt, wherein the somersault belt is an inflatable somersault belt comprising at least one chamber and at least one valve, and wherein the at least one chamber comprises at least a number of wires placed between an outer side and an inner side of the inflatable somersault belt.

2. Gymnastics gear according to claim 1, wherein the gymnastics gear furthermore comprises a number of the connection elements in the form of straps, where one or more of the straps include a joining device for connecting to a complementary joining device on either the strap itself, on the second ring, or on an inflatable somersault belt.

3. Gymnastics gear according to any claim 1, wherein the second ring comprises a recess along the periphery, where the recess comprises an opening, where the opening is adapted to receive one or more connection elements, where said opening has a size which is narrower than the recess itself.

4. Gymnastics gear according to claim 1, wherein the connection elements comprise a joining device, where the joining device comprises mechanical coupling elements.

5. Gymnastics gear according to claim 1, wherein the first ring is of fiber composite.

6. Gymnastics gear according to claim 1, wherein there is arranged between the first ring and the second ring a number of bearing balls and/or bearing rollers, where said bearing balls and bearing rollers are made of steel, ceramics, or some other suitable shape-stable and friction-resistant material.

7. Inflatable somersault belt for use in the gymnastics gear according to claim 1, wherein the inflatable somersault belt comprises at least one chamber and at least one valve and a number of connection elements to connect the inflatable somersault belt to the twisting belt, and wherein the at least one chamber comprises at least a number of wires placed between the outer side and the inner side of the inflatable somersault belt.

8. Method for use of a gymnastics gear according to claim 1, where the method involves at least the following steps:

at least the inflatable somersault belt is placed around the body of a gymnast, a gas species is pumped via a valve into the at least one chamber of the inflatable somersault belt.

9. Method for use of a gymnastics gear according to claim 8, wherein the gas species is air.

10. Gymnastics gear according to claim 2, wherein the joining device is selected from the group consisting of hook-and-loop fasteners (VELCRO™), buckles, couplings or combinations thereof.

11. Gymnastics gear according to claim 1, wherein the gymnastics gear furthermore comprises a number of the connection elements in the form of four or more straps, where one or more of the straps include a joining device for connecting to a complementary joining device on either the strap itself, on the second ring, or on an inflatable somersault belt.

12. Gymnastics gear according to claim 11, wherein all the four or more straps comprise the joining device.

13. Gymnastics gear according to claim 11, wherein the joining device is selected from the group consisting of hook-and-loop fasteners (VELCRO™), buckles, couplings or combinations thereof.

14. Gymnastics gear according to claim 5, wherein the fiber composite includes fibers selected from the group consisting of glass fibers, carbon fibers, vegetable fibers or combinations thereof.

15. Gymnastics gear according to claim 1, wherein the second ring is of fiber composite.

16. Gymnastics gear according to claim 15, wherein the fiber composite includes fibers selected from the group consisting of glass fibers, carbon fibers, vegetable fibers or combinations thereof.

* * * * *